US009676108B2

(12) United States Patent
Beugels et al.

(10) Patent No.: US 9,676,108 B2
(45) Date of Patent: Jun. 13, 2017

(54) PIVOTING ARRANGEMENT

(75) Inventors: Johannes Beugels, Peize (NL); Ray Knoph, Vastra Frolunda (SE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 13/320,922

(22) PCT Filed: May 21, 2010

(86) PCT No.: PCT/IB2010/052267

§ 371 (c)(1),
(2), (4) Date: Nov. 17, 2011

(87) PCT Pub. No.: WO2010/136943

PCT Pub. Date: Dec. 2, 2010

(65) Prior Publication Data

US 2012/0060382 A1 Mar. 15, 2012

(30) Foreign Application Priority Data

May 28, 2009 (EP) ..... 09161317

(51) Int. Cl.
*B26B 19/48* (2006.01)
*B26B 19/04* (2006.01)

(52) U.S. Cl.
CPC ..... *B26B 19/048* (2013.01)

(58) Field of Classification Search
CPC ... B26B 19/046; B26B 19/048; B26B 21/225; B26B 21/521; B26B 19/14; B26B 19/12; B26B 19/04; B26B 19/063
(Continued)

(56) References Cited

U.S. PATENT DOCUMENTS 2,331,466 A * 10/1943 Going ..... 30/34.1
2,386,536 A * 10/1945 Duryea ..... B26B 21/52 30/41

(Continued)

FOREIGN PATENT DOCUMENTS

| | | | |
|---|---|---|---|
| WO | 0139937 | A1 | 6/2001 |
| WO | 2005007355 | A1 | 1/2005 |
| WO | 2007037251 | A1 | 4/2007 |

*Primary Examiner* — Jonathan Riley

(57) ABSTRACT

A pivoting arrangement for a shaving device, comprising a pivoting member (10), adapted to support a shaving head, a cradle (11), pivotally supporting the pivoting member, and a spring loading arrangement (13) arranged to bias the pivoting member in a resting position. The spring loading arrangement has a limited active range, so that, when the pivoting member is brought out of the resting position in a first pivoting direction, the spring loading arrangement is prevented from interacting with the pivoting member in a first point of action (14*a*), and when the pivoting member is brought out of the resting position in a second pivoting direction, the spring loading arrangement is prevented from interacting with the pivoting member in a second point of action (14*b*). As a result, the resting position will not be dependent on e.g. the spring constants of different springs in the spring loading arrangement. The resting position will thus be more exactly defined, and exhibit less variation than conventional solutions. Also, the total force acting on the pivoting member will be reduced, thus causing less friction, also serving to improve the predictability of the arrangement.

6 Claims, 7 Drawing Sheets

(58) Field of Classification Search
USPC ... 30/43.7–45, 527–530, 234, 237–239, 194, 30/198, 212
See application file for complete search history.

(56) References Cited

U.S. PATENT DOCUMENTS

| | | | | | |
|---|---|---|---|---|---|
| 2,793,430 | A | * | 5/1957 | Carissimi | 30/43.92 |
| 2,859,513 | A | * | 11/1958 | Bylund | 30/43.92 |
| 3,144,571 | A | * | 8/1964 | Kukulski | 310/29 |
| 3,166,842 | A | * | 1/1965 | Christensen et al. | 30/43.1 |
| 3,172,201 | A | * | 3/1965 | Wich et al. | 30/43.92 |
| 3,321,831 | A | * | 5/1967 | Harr et al. | 30/45 |
| 3,339,277 | A | * | 9/1967 | Locke et al. | 30/34.2 |
| 3,456,341 | A | * | 7/1969 | Loner et al. | 30/34.1 |
| 3,521,093 | A | * | 7/1970 | Harms | 310/19 |
| 3,552,010 | A | * | 1/1971 | Locke | 30/43.92 |
| 3,593,416 | A | * | 7/1971 | Edson | B26B 21/14 30/50 |
| 3,855,697 | A | * | 12/1974 | Meyer et al. | 30/34.1 |
| 4,003,131 | A | * | 1/1977 | Groothuis | 30/43.92 |
| 4,797,997 | A | * | 1/1989 | Packham | B26B 19/046 30/43.1 |
| 4,970,784 | A | * | 11/1990 | Althaus | B26B 21/225 30/50 |
| 5,050,301 | A | * | 9/1991 | Apprille, Jr. | 30/529 |
| 5,185,926 | A | * | 2/1993 | Locke | 30/43.92 |
| 5,533,263 | A | * | 7/1996 | Gilder | B26B 21/225 30/527 |
| 5,551,154 | A | * | 9/1996 | Tanahashi et al. | 30/43.92 |
| 5,787,593 | A | * | 8/1998 | Althaus | 30/527 |
| 5,953,824 | A | * | 9/1999 | Ferraro et al. | 30/527 |
| 5,953,825 | A | * | 9/1999 | Christman et al. | 30/527 |
| 6,115,924 | A | * | 9/2000 | Oldroyd | B26B 21/225 30/526 |
| 6,301,786 | B1 | * | 10/2001 | Oswald et al. | 30/43.92 |
| 6,381,857 | B1 | * | 5/2002 | Oldroyd | 30/527 |
| 6,711,823 | B2 | | 3/2004 | Floessholzer | |
| 7,152,512 | B1 | | 12/2006 | Prochaska | |
| 2002/0104223 | A1 | * | 8/2002 | Oldroyd | 30/532 |
| 2002/0116822 | A1 | * | 8/2002 | Coffin | B26B 21/225 30/34.2 |
| 2002/0157257 | A1 | * | 10/2002 | Oswald | 30/43.92 |
| 2004/0181953 | A1 | * | 9/2004 | Follo et al. | 30/527 |
| 2004/0231160 | A1 | * | 11/2004 | Shiba et al. | 30/43.92 |
| 2005/0138821 | A1 | * | 6/2005 | Tsushio et al. | 30/527 |
| 2006/0137187 | A1 | * | 6/2006 | Fukutani et al. | 30/43.92 |
| 2006/0265880 | A1 | * | 11/2006 | Sagawa | 30/43.92 |
| 2007/0124936 | A1 | | 6/2007 | Okabe | |
| 2009/0241343 | A1 | * | 10/2009 | Yamasaki et al. | 30/43.92 |
| 2010/0180448 | A1 | * | 7/2010 | Sato et al. | 30/43.92 |
| 2012/0255185 | A1 | * | 10/2012 | Patel et al. | 30/527 |

* cited by examiner

PIVOTING ARRANGEMENT

FIELD OF THE INVENTION

The present invention relates to a pivoting arrangement for a device having a contour following function such as e.g. a shaving device.

BACKGROUND OF THE INVENTION

Conventional shaving and grooming devices are sometimes equipped with a pivoting arrangement providing a contour following function. Contour following functions are known from other devices as well such as epilators, skin rejuvenation, wrinkle treatment and trimming devices. In some pivoting arrangements, a moving part of the shaving head is spring loaded towards an extreme angular position, so that it assumes this extreme position when it is not submitted to any external forces.

In other pivoting arrangements a moving part of the shaving head is arranged to assume a predefined resting position, e.g. a middle position, when it is not submitted to any external forces. This resting position can be spring loaded.

Such a conventional middle position pivoting arrangement is known from U.S. Pat. No. 6,301,786, and is schematically shown in FIG. 1. A pivoting member 1 is supported by a supporting member or cradle 2, allowing it to pivot around an axis A. Two (or more) spring members 3 are arranged at the base plate 4 of the supporting member or cradle 2. When the pivoting member is in an unbiased resting position, as shown in FIG. 1, both spring members 3 are preloaded against the pivoting member 1. When the pivoting member is forced out of its resting position, it will depress one of the springs further, while extending the other spring. The force of the depressed spring will now become greater than the force from the extended spring, thus offsetting the equilibrium of the springs, and creating a net force acting on the pivoting member towards the middle position.

A potential problem with such conventional pivoting arrangements is that if the two springs have, or grow to have, slightly different spring constants, the equilibrium of the springs may become permanently offset, so that the pivoting member will fail to resume its middle position after being depressed. As a result, the resting position of the pivoting member will no longer be the middle position, but a slightly angled position.

SUMMARY OF THE INVENTION

It is an object of the present invention to overcome this problem, and to provide a pivoting arrangement for a device having a contour following function such as e.g. a shaving device with less variation of the resting position.

This and other objects are achieved by a pivoting arrangement for a device having a contour following function such as e.g. a shaving device, comprising a pivoting member, adapted to support a shaving head, a cradle, pivotally supporting the pivoting member, and a spring loading arrangement comprising at least one deformable spring element, and arranged to interact with the pivoting member in a first point of action to exert a force acting to move the pivoting member in a first pivoting direction, and in a second point of action to exert a force acting to move the pivoting member in a second pivoting direction, the spring loading arrangement thereby biasing the pivoting member in a resting position. The spring loading arrangement further has a limited active range, so that, when the pivoting member is brought out of the resting position in the first pivoting direction, the spring loading arrangement is prevented from interacting with the pivoting member in the first point of action, and when the pivoting member is brought out of the resting position in the second pivoting direction, the spring loading arrangement is prevented from interacting with the pivoting member in the second point of action.

The active range of the spring loading arrangement is thus limited, so that the spring loading arrangement will only exert forces that act to return the pivoting member to its resting position. As a result, the resting position will not be dependent on e.g. the spring constants of different springs in the spring loading arrangement. The resting position will thus be more exactly defined, and exhibit less variation than conventional solutions. Also, the total force acting on the pivoting member will be reduced, thus causing less friction, also serving to improve the predictability of the arrangement.

The term "resting position" should here be interpreted primarily as a desired "default" position of the pivoting member, but also a small angular range around this position. In other words, it is possible that the pivoting member may be moved slightly in its resting position, without any force being exerted by the spring loading arrangement. Such a "free" angular range may be caused by play in the mechanical construction, or be a result of wear.

The spring loading arrangement can comprise at least two abutments, against which said spring loading arrangement is arranged to abut, thereby limiting the active range of the spring loading arrangement. The abutments thus serve to prevent the spring loading arrangement from interacting with the pivoting arrangement.

The spring loading arrangement may be preloaded against the abutments when the pivoting member is in its resting position. Such preloading will ensure that a well defined force is exerted by the spring member in its active range, i.e. when acting to return the pivoting member to the resting position.

According to one embodiment, the spring loading arrangement comprises at least two deformable spring elements, each arranged to interact with the pivoting member in one of the points of action. This can be a mechanically simple way to realize an embodiment of the present invention.

The spring elements may have different spring coefficients. As a result, a greater force will be required in order to pivot the pivoting member in a first direction than in a second direction. This may be advantageous in specific applications of the pivoting arrangement.

An abutment is an efficient way to restrict the active range of a deformable spring member, such as a coil spring, a leaf spring, or a torsion spring. The spring member will be active until it abuts the abutment, which thus limits the expansion (or contraction) of the spring member. By arranging the spring and the abutment so that this occurs at the resting position, the advantages mentioned above will be achieved.

For example, each abutment can be arranged to cooperate with a spring element such that, when the pivoting member is brought out of the resting position in one direction, the spring element is deformed, thereby exerting a force on the pivoting member, and, when the pivoting member is brought out of the resting position in another direction, the spring element abuts the abutment, and is brought out of contact with the pivoting member.

The deformable spring element can be arranged to be compressed when the pivoting member is brought out of the resting position in the first direction, and the abutment can then be arranged to restrict extraction of the deformable spring element. Alternatively, the deformable spring element can be arranged to be extracted when the pivoting member is brought out of the resting position in the first direction, and the abutment can then be arranged to restrict compression of the deformable spring element.

According to another embodiment, the spring loading arrangement comprises a force transfer element arranged to interact with said pivoting member in said first and second points of action and a deformable spring element arranged to bias the force transfer element towards the pivoting member, so that, when the pivoting member is brought out of its resting position in the first direction, the pivoting member engages the force transfer element in said second point of action, and moves the force transfer element so as to separate the force transfer element from the pivoting member in said first point of action.

According to this embodiment, only one spring element is required, as the force transfer element transfer the force from this spring element to all points of action with the pivoting member. In this case, the spring loading arrangement can be preloaded against the pivoting member in the resting position, eliminating the need for separate abutments.

According to a further embodiment, the cradle is pivotable around a first axis, and the pivoting arrangement may further comprise an outer cradle in which the cradle is pivotable around a second axis and a second spring loading arrangement, arranged to bias said cradle in a resting position. The pivoting member will thus be movable in any direction.

It is noted that the invention relates to all possible combinations of features recited in the claims.

BRIEF DESCRIPTION OF THE DRAWINGS

This and other aspects of the present invention will now be described in more detail, with reference to the appended drawings showing a currently preferred embodiment of the invention.

DETAILED DESCRIPTION OF EMBODIMENTS

The following embodiments of pivoting arrangements according to the present invention may be useful in various types device having a contour following function such as e.g. shaving or grooming devices, where a contour following head such as e.g. a shaving head may be supported by the pivoting member, so as to allow for a contour following function. The following embodiments show the invention being implemented in a device having a shaving function. However, it should be noted that the invention is not limited to shaving devices as such and that the embodiments show non-limiting examples of the invention. Therefore, the details of the shaving device itself and its function will be described only very briefly, as they are not immediately relevant for the description of the present invention.

Figure 1:
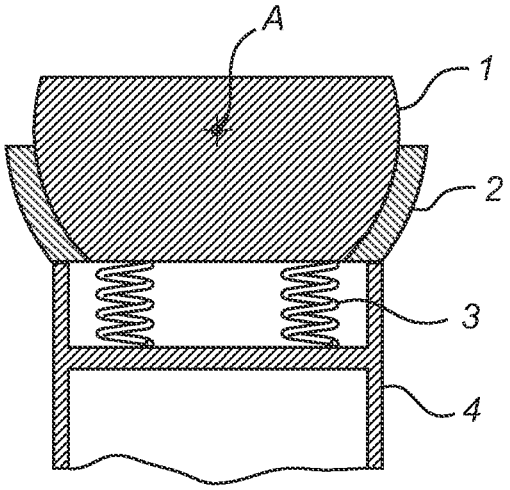
(Prior art) FIG. 1
FIG. 1 shows a pivoting arrangement according to prior art.
Figure 2A:
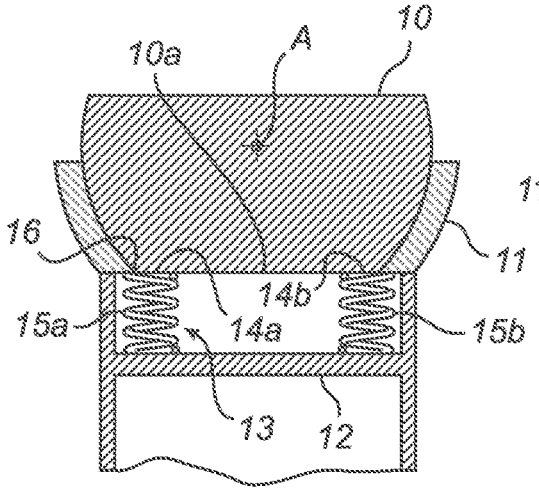
FIG. 2*a* shows a pivoting arrangement according to a first embodiment of the present invention, in a resting position.

The pivoting arrangement shown in FIG. 2*a* comprises a pivoting member 10, which is pivotally arranged in a cradle 11. The cradle 11 is in turn arranged on a supporting structure, here referred to as a base plate 12. The pivoting member 10 is adapted to support a shaving head (not shown), and may be provided with a pre-trimmer (not shown). Depending on the type of device, and the function of the pivoting member, the pivoting member 10 may be pivotable around a point or axis A. For this purpose, the pivoting member may rest on a suspension point or axle, which it is pivotable around. Alternatively it may be guided by e.g. grooves in the cradle 11, so as to be pivotable around an imaginary pivoting point or axis.

In order to keep the pivoting member in a neutral resting position (FIG. 2*a*), the pivoting member 10 is spring loaded by a spring loading arrangement 13, arranged to exert a force on both the cradle and the pivoting member. The spring loading arrangement can interact with the pivoting member 10 in at least two points of action 14*a*, 14*b*, to allow exertion of force in at least two directions of rotation around the pivoting axis A. If the pivoting member is pivotable around a point, the spring loading arrangement can preferably interact with the pivoting member in at least three points of action.

Figure 2B:
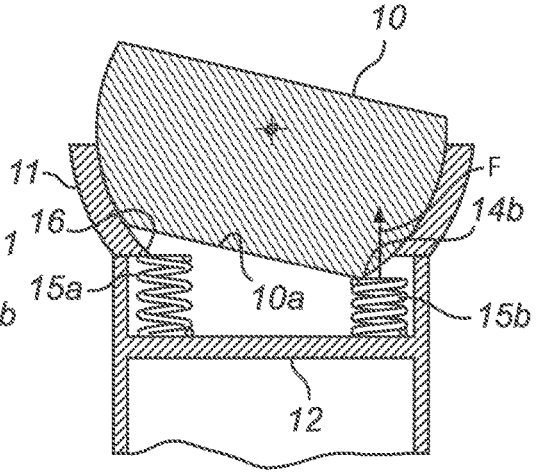
FIG. 2*b* shows the pivoting arrangement in FIG. 2*a*, in a working position.

In the embodiment in FIG. 2*a-b*, the spring loading arrangement 13 comprises two coil springs 15*a*, 15*b* that are clamped between the cradle 11 and the base plate 12. As the cradle 11 is fixed in relation to the base plate 12, the springs can exert a force on both the cradle 11 and the pivoting member 10.

The spring loading arrangement may further comprise a force reliving structure. Again referring to the embodiment in FIG. 2*a-b*, the force relieving structure here comprises two abutments 16 formed by protruding portions of the cradle 11, against which the springs are preloaded. As is clear from FIG. 2*a*, the abutments 16 are located so that the pivoting member 10 in the resting position will be in level with the abutments. A surface 10*a* of the pivoting member 10 will thus be immediately adjacent, and possibly in contact with, the preloaded springs.

Turning to FIG. 2*b*, the pivoting member 10 has now been rotated around the axis A, and brought out of its resting position. On the left side, the surface 10*a* of the pivoting member has then moved away from the abutment 16 against which the spring 15*a* abuts, and this spring 15 is therefore prevented from interacting with the pivoting member 10. On the right side, the spring 15*b* has been further depressed by the surface 10*a* of the pivoting member, and therefore exerts a force F on the pivoting member 10 in the point of action 14*b*, acting to return the pivoting member to the resting position.

Figure 3A:
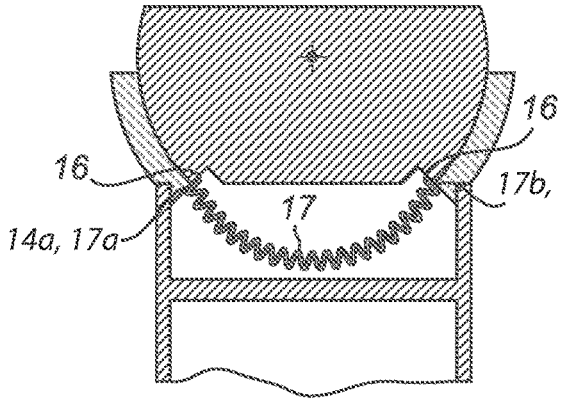
FIG. 3*a* shows a pivoting arrangement according to a second embodiment of the present invention, in a resting position.
Figure 3B:
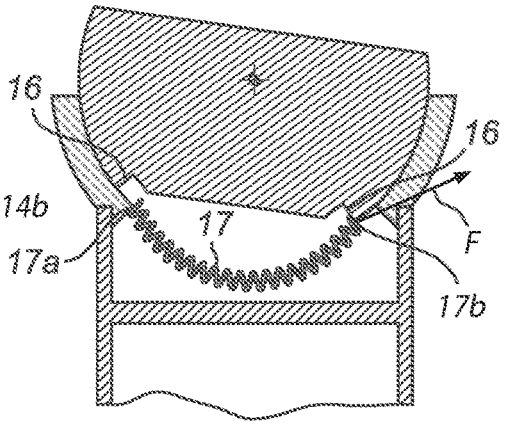
FIG. 3*b* shows the pivoting arrangement in FIG. 3*a*, in a working position.

The skilled person will realize that the springs 15*a*, 15*b* in FIG. 2*a-b* also could be arranged above the points of actions, so that the spring on the left side is depressed as this part of the pivoting member 10 moves upwards (in the reference frame of FIG. 2*b*). In other words, although in FIG. 2 *a-b* the springs 15*a* and 15*b* are arranged between the base plate 12 and the cradle 11, other configurations are possible as well. E.g. configurations wherein the springs are located at the top sides of the cradle In another embodiment, illustrated in FIG. 3*a-b*, the two springs have been substituted by one spring 17, arranged with each of its two ends 17*a*, 17*b* in one of the points of action 14*a*, 14*b*. As is clear from FIGS. 3*a-b*, the function of the spring and abutments is very similar to that described with reference to FIG. 2*a-b*. In FIG. 3*b*, when the pivoting member 10 is rotated around the axis A, the left end 17*a* of the spring 17 abuts against the abutment 16. The right end 17*b* of the spring 17 is depressed by the pivoting member 10, and therefore exerts a force F on the pivoting member 10 in the point of action 14*b*, acting to return the pivoting member to the resting position.

Figure 4A:
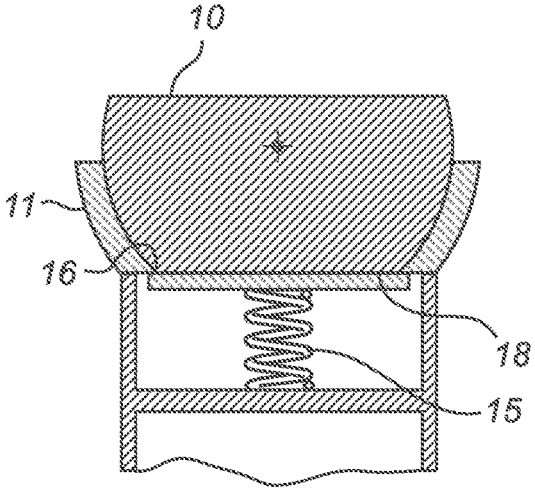
FIG. 4*a* shows a pivoting arrangement according to a third embodiment of the present invention, in a resting position.
Figure 4B:
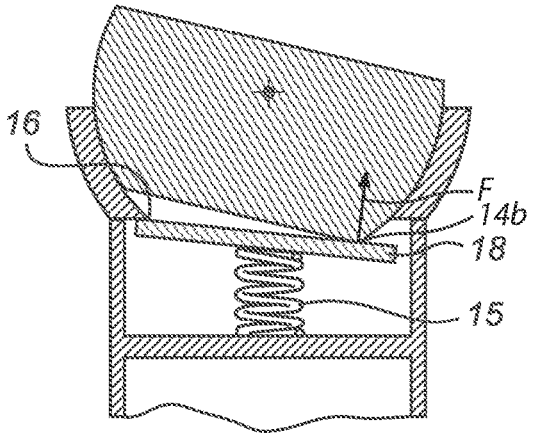
FIG. 4*b* shows the pivoting arrangement in FIG. 4*a*, in a working position.

In yet another embodiment, illustrated in FIG. 4*a-b*, the spring loading arrangement comprises a force transfer element in the form of a plate 18, preloaded against the abutments 16 by a single spring element 15. When the pivoting member is brought out of its resting position in FIG. 4*a*, into a working position in FIG. 4*b*, one side of the pivoting member 10 pushes down on the plate 18, thereby causing the spring to exert a force F on the pivoting member in a point of action 14*b* acting to return it to its resting position. The other side of the pivoting member is moved away from and out of contact with the plate 18, which here abuts against the abutment 16. The resulting function is much similar to that in FIG. 2*a-b*.

Figure 5A:
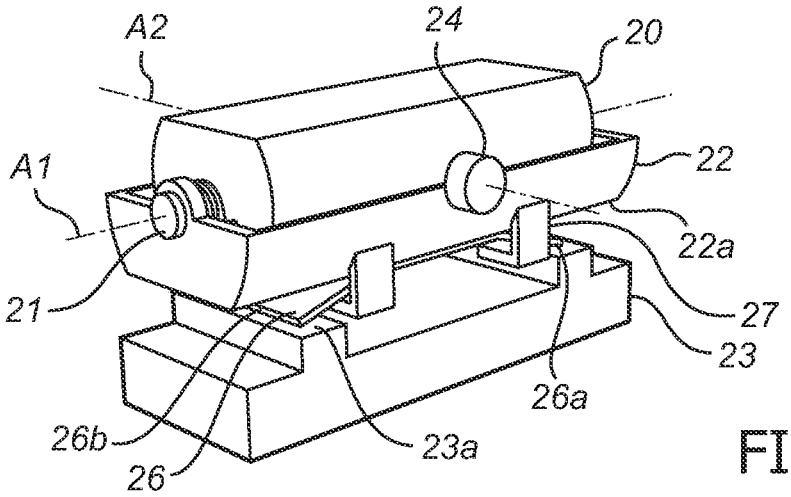
FIG. 5*a* shows a pivoting arrangement according to a fourth embodiment of the present invention, having two axis of rotation, in a resting position.
Figure 5B:
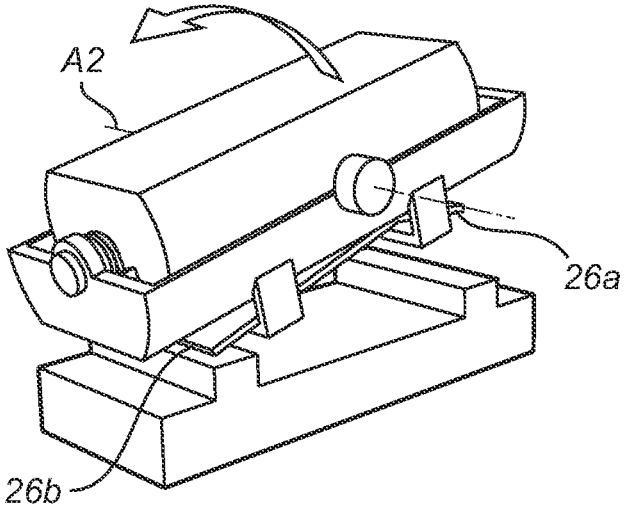
FIG. 5*b* shows the pivoting arrangement in FIG. 5*a*, in a first working position rotated around a first axis.
Figure 5C:
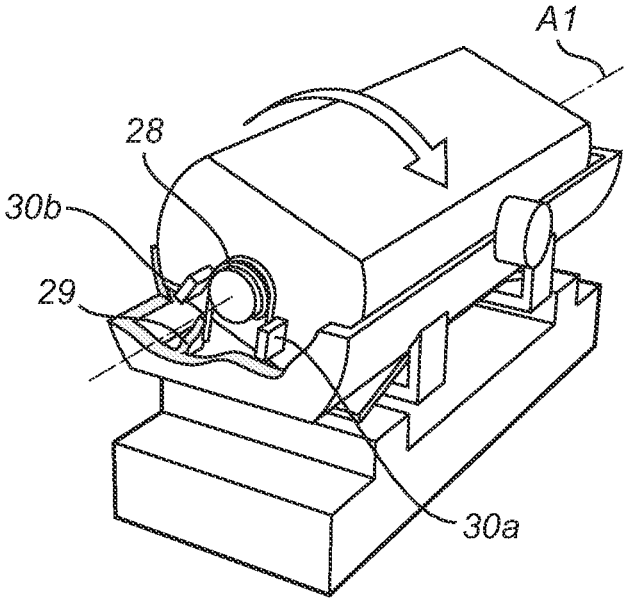
FIG. 5*c* shows the pivoting arrangement in FIG. 5*a*, in a second working position rotated around a second axis.

FIG. 5*a-c* shows a further embodiment, according to which the pivoting arrangement is able to allow the pivoting member 20 to pivot around two different axes. For this purpose, the pivoting member 20 is suspended by two axles 21 in the cradle 22, so as to be pivotable around a first axis A1. The cradle is then in itself supported by the supporting structure, here referred to as an outer cradle 23, to be pivotable around a second axis A2. The cradle 22 can be guided by grooves (not shown) in the outer cradle 23, so as to be movable in relation to the outer cradle 23, or be suspended by additional axles 24.

The pivoting member 20 is adapted to follow a contour following element. The pivoting member 20 having mounted thereto, two axles stubs 21 which are arranged and exclusively mounted to respective first and second distal ends of the pivoting member 20. FIG. 5A-5C shows one of the two axles 21 connected to a first distal end of the pivoting member 20. The cradle 22 includes a pair of end panels and a pair of side panels, where the end panels and the side panels are interconnected at peripheral portions thereof so as to define the cradle 22, configured as a cavity for partially receiving the pivoting member. The cradle 22 further includes two recessed portions located at the first and second distal ends along the axis A1, where the recessed portions are configured to receive the respective first and second axle stubs 21 of the pivoting member 20.

The spring loading arrangement in FIG. 5 comprises a leaf spring 26, which is fixed to the underside 22*a* of the cradle 22 by two clamps 27, preferably preloading the leaf spring 26 against the cradle 22. In the resting position (FIG. 5*a*) the two ends 26*a*, 26*b* of the leaf spring are arranged to be located immediately adjacent to the surface 23*a* of the outer cradle 23. As the pivoting member is rotated (FIG. 5*b*), one end 26*a* of the leaf spring is "lifted" so as to lose contact with the surface of the outer cradle 23. The other end 26*b* is pressed more firmly against the outer cradle 23, and will cause the leaf spring 26 to exert a force on the cradle 22 acting to return it to the resting position.

In analogy to the embodiment in FIG. 2, the leaf spring 26 could be replaced by two or more leaf springs, each having only one point of action with the pivoting member.

The spring arrangement in FIG. 5 further comprises a torsion spring 28, arranged around the axle stub 21 of the pivoting member 20, and preloaded in one rotational direction by abutments 29 on the inner wall of the cradle 22. The pivoting member 20 is also provided with abutments 30*a-b* on either side of the spring 28, arranged to cooperate with the torsion spring when the pivoting member 20 is rotated. FIG. 5*c* illustrates rotation of the pivoting member 20. One of the abutments 30*a* is moved towards and compresses the torsion spring, thus creating a force acting to return the pivoting member to its resting position. The other abutment 30*b* is moved out of contact with the torsion spring, which on this side remains preloaded against the abutment 29.

Figure 6:
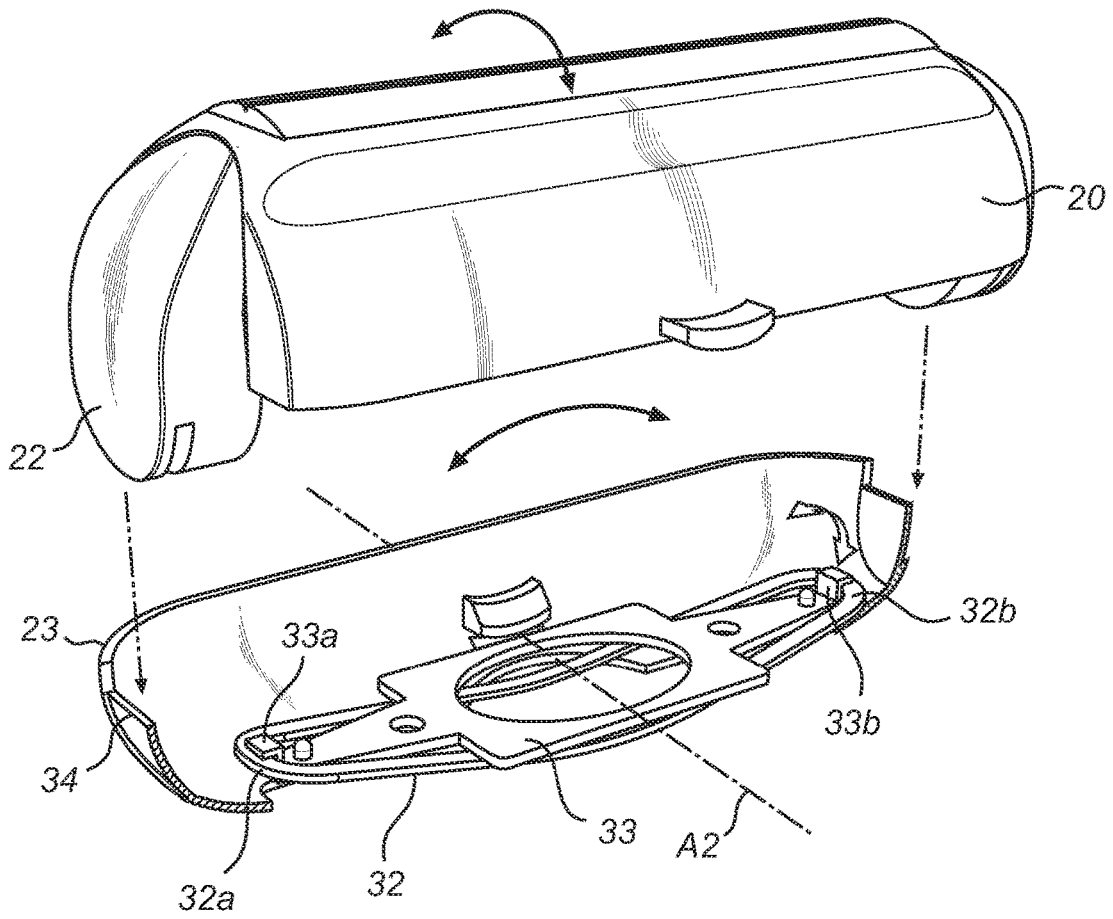
FIG. 6 shows an alternative arrangement of the leaf spring arrangement in FIG. 5*a*.

FIG. 6 is a perspective view of a pivoting arrangement similar to that in FIG. 5*a-c*, where the upper part, including the pivoting member 20 and the cradle 22, has been exploded away from the outer cradle 23. As a result, only the part of the spring loading arrangement that acts between the cradle 22 and the outer cradle 23 is shown in detail. In this case, the leaf spring is formed by an oval shaped metal element 32. This spring element 32 is fixed to the outer cradle 23 by a holder in the form of a metal plate 33, which is fixed (by screws or the like) to the outer cradle 23. The outer ends 33*a*, 33*b* of the plate 33 are formed to grip the ends 32*a*, 32*b* of the spring element 32, thereby acting as abutments that pretension the element 32. The cradle 22 is arranged to be guided by the edges 34 of the outer cradle, to be pivotable around an axis A2. Further, the underside of the cradle 22 is arranged to rest on the oval element, at points of action on either end of the spring element 32.

When the cradle 22 is brought out of its resting position, one end of the cradle 22 will move towards the outer cradle 23, and at his end it will depress the spring element 32, thereby creating a force acting to return the cradle 22 to its resting position. The opposite side of the cradle 22 will move away from the outer cradle 23, and thus loose contact with the spring element 32, which here will abut against the holder 33.

It may be noted that the spring element 32 in FIG. 6 is oriented in an opposite fashion compared to the leaf spring 26 in FIG. 5, but has an otherwise similar function.

Figure 7A:
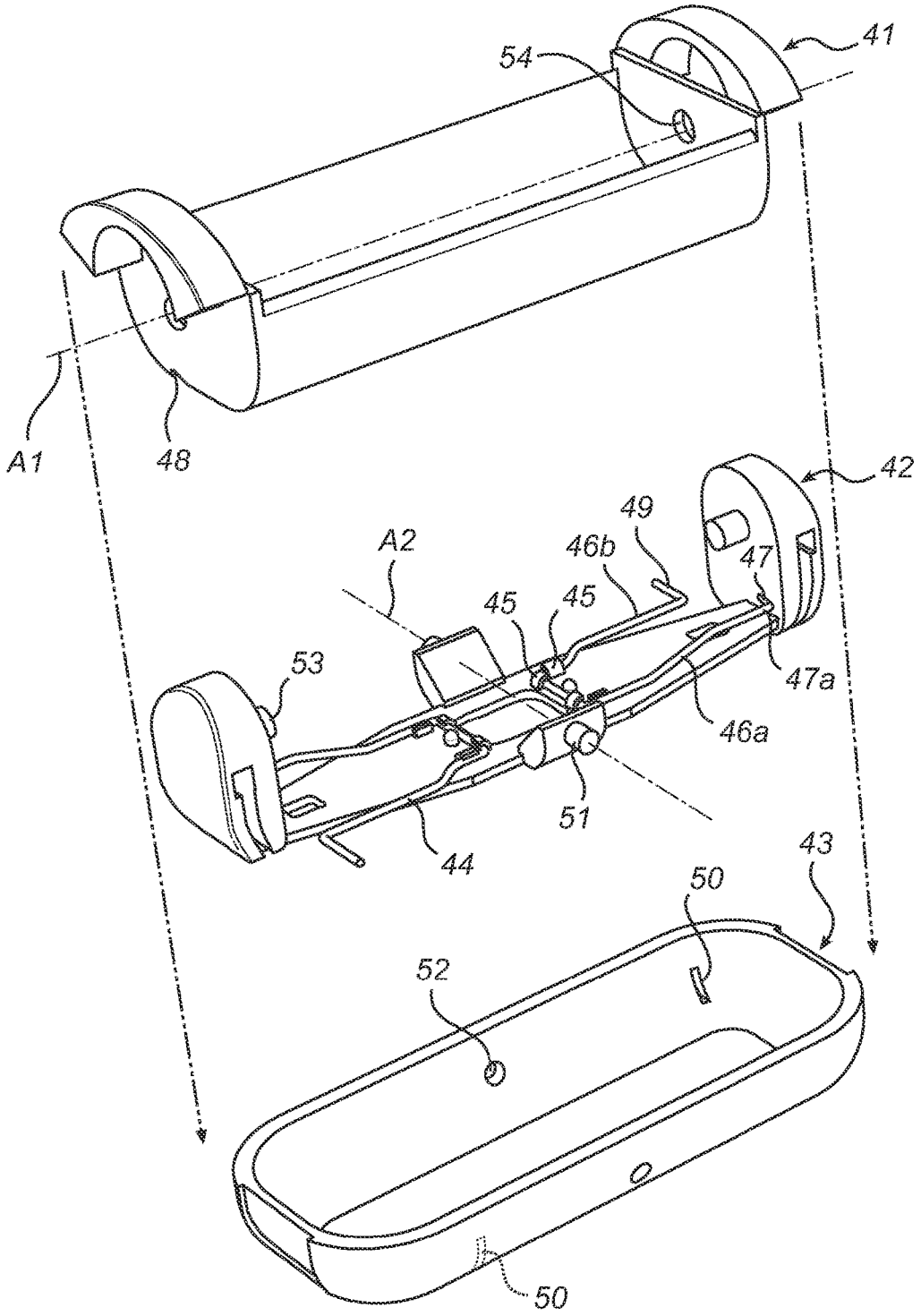
FIG. 7*a* shows an exploded view of a pivoting arrangement according to a fourth embodiment of the invention, having two axis of rotation.

FIG. 7*a* shows yet another embodiment of a double axis pivoting arrangement according to the present invention. Similar to the embodiments in FIGS. 5 and 6, the pivoting arrangement here comprises a pivoting member 41, a cradle 42, and an outer cradle 43. The cradle has two axles 53, arranged to cooperate with holes 54 in the pivoting member 41, to allow rotation of the pivoting member 41 around an axis A1. The cradle has two axles 51 arranged to cooperate with holes 52 in the outer cradle 43, to allow rotation of the cradle 42 around an axis A2.

The spring loading arrangement is formed by two spring elements 44, each in the form of a substantially U-shaped wire, fitted to the cradle by means of protrusions 45 cooperating with the wire to hold it in place, e.g. by snap fitting.

Each wire 44 is arranged with its legs 46*a*, 46*b* extending from the center of the cradle towards its outer ends. One of the legs 46*a* extends into an elongated grove 47 in an end plate 48 of the cradle 42, and is preloaded to abut against the outer edge 47*a* of this grove. The underside of the pivoting member 41 further has an indentation 48 that is formed to cooperate with the leg 46*a*. The other leg 46*b* has an end portion 49 that is bent outwards, and adapted to, when the cradle 42 is mounted in the outer cradle 43, extend into a groove 50 in the outer cradle, and be in contact with the upper edge of the groove 50.

Figure 7B:
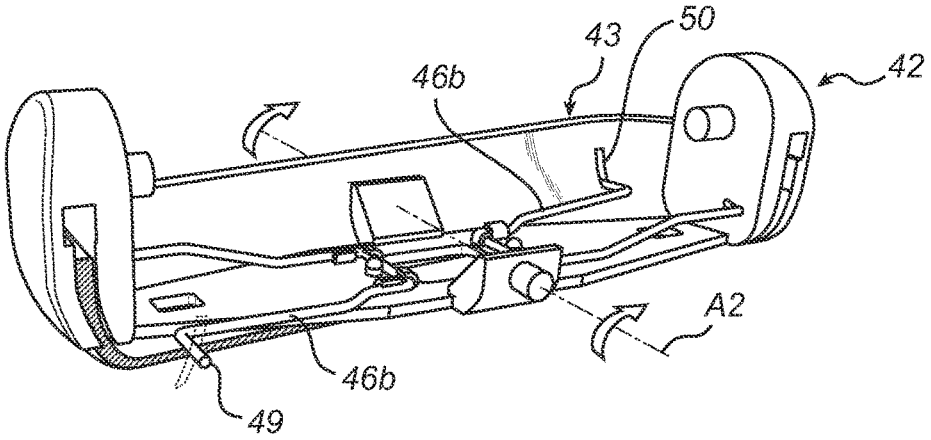
FIG. 7*b* shows selected parts of the pivoting arrangement in FIG. 7*a*, with the cradle rotated around the axis A1.

With reference to FIG. 7*b*, when the cradle 42 is rotated around the axis A2, the two legs 46*b* will serve as a spring loading arrangement similar to that described in relation to FIGS. 5*a* and 5*b*. On the side of the cradle 42 that is moved away from the outer cradle 43, the end portion 49 of the leg 46*b* will be pressed against the upper edge of the groove 50, thus causing a force to be exerted on the cradle 42 to return it to the resting position. On the other side of the cradle 42, moving towards the outer cradle 43, the portion 49 will be brought out of contact with the groove 50, thus preventing any force to be exerted.

Figure 7C:
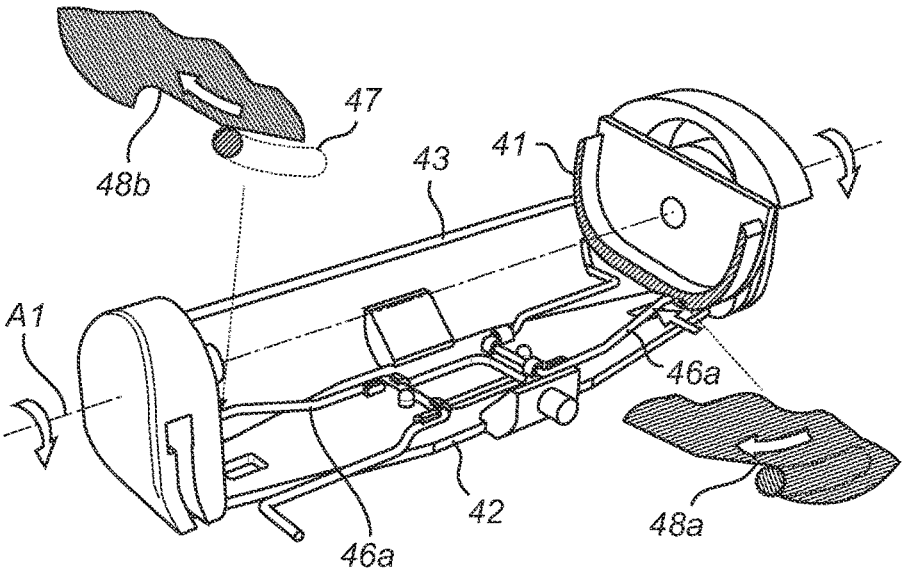
FIG. 7*c* shows selected parts of the pivoting arrangement in FIG. 7*a*, with the pivoting member rotated around the axis A2.
Figure 8:
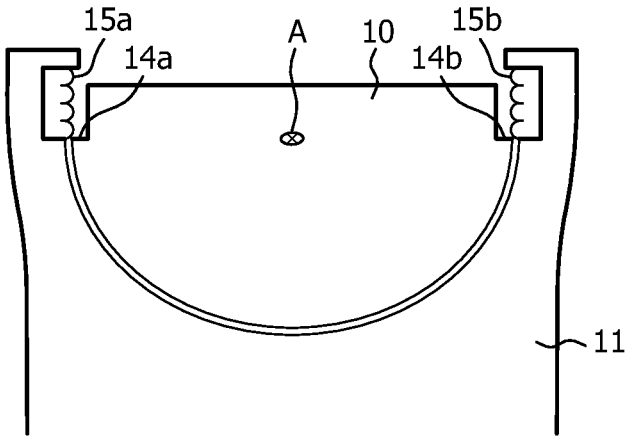
FIG. 8 shows a pivoting arrangement according to another embodiment with the pivoting member rotated around axis A.

Turning now to FIG. 7*c*, when the pivoting member 41 is rotated around axis A1, one of the indentations 48*a* will engage with the preloaded leg 46*a*, thereby causing a force to be exerted on the pivoting member 41. The other indentation 48*b*, on the other side of the pivoting member, will move away from the corresponding leg 46*a*, thus avoiding any force.

The person skilled in the art realizes that the present invention by no means is limited to the preferred embodiments described above. On the contrary, many modifications and variations are possible within the scope of the appended claims. For example, the shape of the various components may be modified, as can the type and number of spring elements.

The invention claimed is:

1. A pivoting arrangement for a shaving device or grooving device having a contour following function, comprising:

a pivoting member, adapted to follow a contour following element, the pivoting member comprising a first and a second axle stub arranged at and exclusively mounted to respective first and second distal ends of the pivoting member, the pivoting member and the first and second axle stubs defining a first longitudinal axis (A1), a singular inner supporting member, the singular inner supporting member including a pair of end panels and a pair of side panels, the end and side panels being interconnected at peripheral portions thereof so as to define a cavity for partially receiving the pivoting member, the inner supporting member further including a first and a second recessed portion for receiving the respective first and second axle stubs of the pivoting member, so as to be pivotable about the first axis, (A1), and wherein each of said first and second axle stubs of the pivoting member are located along the first axis (A1), an outer supporting member supporting said inner supporting member so as to be pivotable about a second axis, perpendicular to said first axis and in the same plane, a spring loading arrangement comprising at least one deformable leaf spring fixedly connected to an underside of the inner supporting member by a first clamp at a first point of connection and by a second clamp at a second point of connection, thereby preloading the at least one deformable leaf spring against the inner supporting member, said leaf spring comprising an oval shaped metal element fixed to the outer supporting member by a metal plate, whereby outer ends of the metal plate are formed to grip respective ends of the leaf spring thereby acting as abutments that pretension the leaf spring, the underside of the inner supporting element being arranged to rest on the oval leaf spring at points of action on either end of the leaf spring, the leaf spring oriented in a substantially horizontal plane, said spring loading arrangement being arranged to be located immediately adjacent to an upper surface of the outer supporting member, said spring loading arrangement being arranged to interact with the outer supporting member in a first point of action to exert a force acting to move the pivoting member in a first pivoting direction, and in a second point of action to exert a force acting to move the pivoting member in a second pivoting direction, said spring loading arrangement located and arranged to exert a simultaneous force on both said inner supporting member and said outer supporting member, said spring loading arrangement arranged to bias said pivoting member in a resting position, wherein said spring loading arrangement has a limited active range, so that, when the pivoting member is not in said resting position in said first pivoting direction, said spring loading arrangement is prevented from interacting with said outer supporting member in said first point of action, and when the pivoting member is brought out of said resting position in said second pivoting direction, said spring loading arrangement is prevented from interacting with said outer supporting member in said second point of action, and a torsion spring arranged around one of the first or second axle stubs of the pivoting member, said torsion spring being preloaded in one rotational directional about a first and second abutment provided on a respective first and second side of an inner wall of said pivoting member, said first and second abutments being arranged to cooperate with the torsion spring when said pivoting member is rotated.

2. The pivoting arrangement of claim 1, wherein the contour following element is a shaving head.

3. The pivoting arrangement of claim 1, wherein the inner supporting member is a cradle.

4. The pivoting arrangement of claim 1, wherein all of the at least one deformable spring elements of said spring loading arrangement is arranged to exert, when the pivoting member is brought out of said resting position, a force which equal or larger than the force exerted by said deformable spring elements when the pivoting member is in its resting position, such that, when the pivoting member is brought out of said resting position, the potential energy stored in all of the at least one deformable spring elements is equal to or larger than the potential energy stored in all of the at least one deformable spring elements when the pivoting member is in its resting position.

5. A shaving or grooming device, comprising the arrangement of claim 1, wherein said pivoting member is adapted to support a shaving head.

6. A device having a contour following function, comprising an arrangement of claim 1, wherein said pivoting member is adapted to support a contour following element.

* * * * *